United States Patent [19]

Millman

[11] Patent Number: 5,040,435

[45] Date of Patent: Aug. 20, 1991

[54] KNIFE EDGE DEBURRING APPARATUS

[75] Inventor: Ronald W. Millman, Bloomington, Minn.

[73] Assignee: General Housewares Corp., Stamford, Conn.

[21] Appl. No.: 648,884

[22] Filed: Jan. 31, 1991

[51] Int. Cl.[5] ..... B24B 3/54

[52] U.S. Cl. ..... 76/86; 51/214; 51/354; 51/212; 76/88

[58] Field of Search ..... 76/82, 86, 82.2, 88; 51/214, 204, 205 WG, 211, 212, 354

[56] References Cited

U.S. PATENT DOCUMENTS

| | | |
|---|---|---|
| 2,435,672 | 2/1948 | Clark . |
| 4,530,188 | 7/1985 | Graves . |
| 4,550,632 | 11/1985 | Inman . |
| 4,624,079 | 11/1986 | Bonapace . |
| 4,912,885 | 4/1990 | Bonapace . |
| 4,934,110 | 6/1990 | Juranitch . |

FOREIGN PATENT DOCUMENTS 517242 1/1940 United Kingdom ..... 51/354

*Primary Examiner*—Roscoe V. Parker
*Attorney, Agent, or Firm*—Emrich & Dithmar

[57] ABSTRACT

A knife deburring or steeling device includes a frame with an elongated knife blade-receiving slot. Deburring rods are crossed over the knife slot in an X-shaped configuration, with the ends of each rod being fixed to slide members having shanks extending respectively through four complementary elongated track slots arranged in pairs which respectively diverge in opposite directions from the opposite ends of the knife slot. Each slide member has an enlarged cylindrical head at one end having a diameter larger than the width of the associated track slot, with each of one pair of slide members having a rectangular foot at the other end with a width less than and a length greater than the width of the associated track slot so that it can be passed through the track slot in a mounting orientation but is locked against removal from the track slot in a use orientation. Each of the other pair of slide members is provided with a C-clip engageable in a cylindrical groove to lock the slide members in place in the associated track slot.

19 Claims, 2 Drawing Sheets

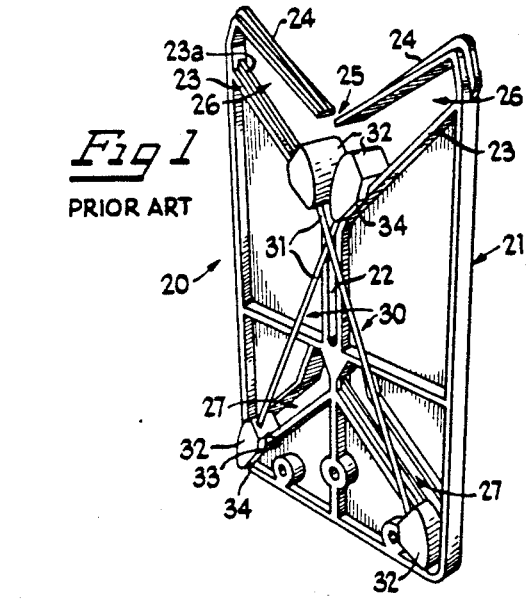
Fig 1
PRIOR ART
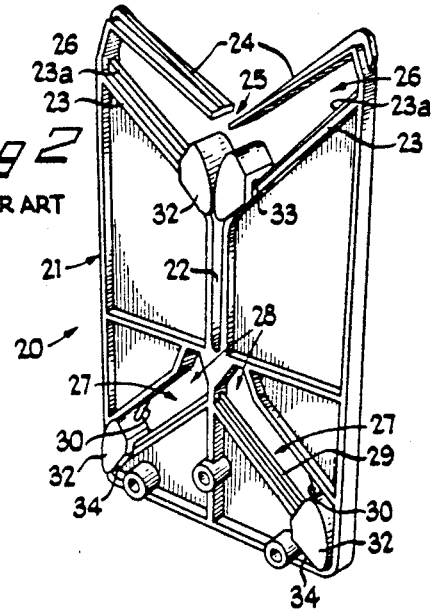
Fig 2
PRIOR ART
Fig 3
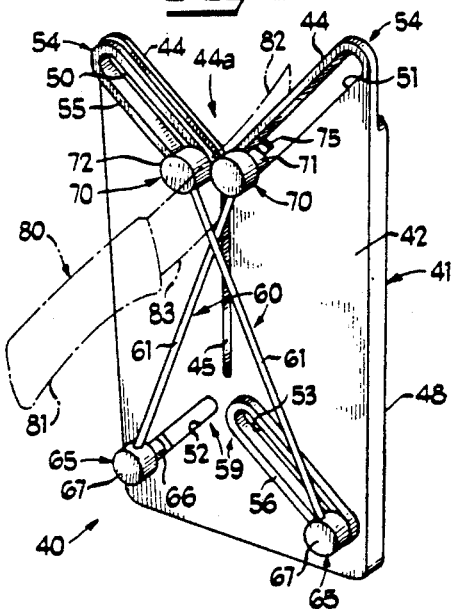
Fig 4
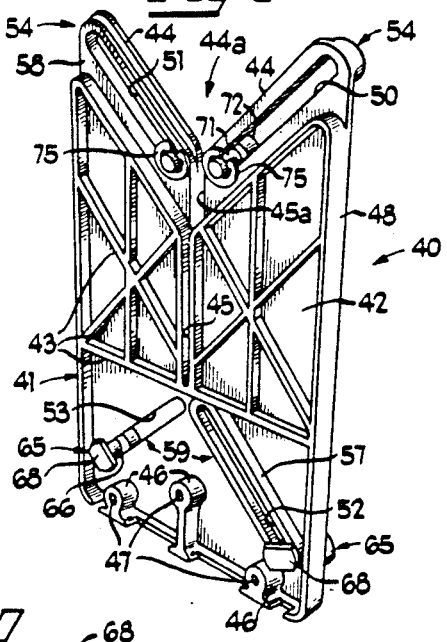
Fig 9
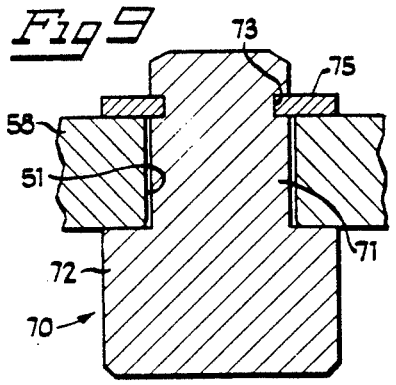
Fig 10
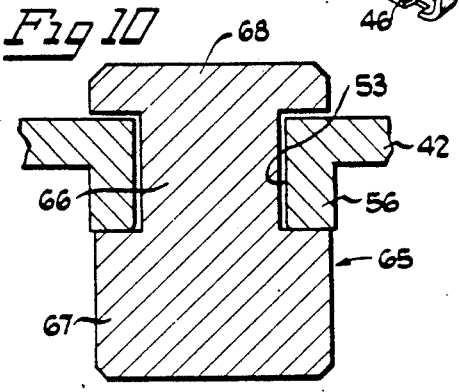

KNIFE EDGE DEBURRING APPARATUS

BACKGROUND OF THE INVENTION

1. Field of the Invention

The present invention relates to devices for maintaining a sharp cutting edge on a knife or other cutting tool, and particularly relates to devices for steeling or deburring the knife edge. The invention has particular application to deburring devices of the type wherein the knife edge is drawn along the intersection of two crossed deburring elements.

2. Description of the Prior Art

A number of knife edge sharpening or maintaining devices are known which utilize a pair of elongated crossed sharpening or deburring elements, wherein the knife edge is drawn through the notch formed by the intersection of the two crossed deburring elements, which elements respectively engage opposite sides of the knife edge. In some such devices a knife-receiving slot is provided for guiding the movement of the knife edge, the deburring elements being crossed so that their intersection overlies the slot. Typically the deburring elements are movably mounted so that, as the knife edge is drawn across their intersection, the pressure of the knife blade against the deburring elements simultaneously moves them so that their intersection point travels along the length of the deburring elements while remaining in alignment with the knife slot.

One such prior art deburring apparatus is disclosed in FIGS. 1 and 2, and is generally designated by the numeral 20. The deburring apparatus 20 includes a generally rectangular frame 21 having an elongated knife slot 22 formed in the upper end thereof. The frame includes of pair of downwardly converging upper edges 23 which lead into the upper end of the knife slot 22, each of the upper edges 23 being provided with a raised rib 23*a* running the length thereof centrally thereof. Projecting respectively from the side edges of the frame 21 at the upper ends thereof are two arms 24, each of which extends upwardly and then downwardly above a corresponding one of the upper edges 23, the inner ends of the arms 24 terminating a slight distance from each other so as to define a gap 25 therebetween. The arms 24 are respectively spaced above the upper edges 23 so as to cooperate therewith to define two inclined upper track slots 26 which converge downwardly and inwardly toward the center of the frame 21 and communicate with each other and with the knife slot 22. The arms 24 are respectively inclined with respect to the upper edges 23, so that the track slots 26 are wider at their inner ends than at their outer ends.

Also formed in the frame 21 at the lower end thereof are a pair of lower track slots 27 which converge upwardly and inwardly toward the lower end of the knife slot 22, but which are discrete therefrom and from each other. Each of the lower track slots 27 has an enlarged upper end 28. Extending the length of the lower edge of each of the lower track slots 27 centrally thereof is a raised rib 29.

A pair of deburring assemblies 30 are provided, each including an elongated cylindrical deburring rod 31 fixed at each end thereof to a. slider 32. Each slider 32 has a channel 33 formed in the lower face thereof defining a pair of depending legs 34. The rods 31 are crossed over the knife slot 22, with the sliders 32 being respectively disposed in the track slots 26 and 27. The channel legs 34 of each sliders 32 straddle the raised rib 23*a* or rib 29 of the corresponding track slot for guiding movement of the sliders 32 along the track slots. The ribs 23*a* are respectively parallel to the ribs 29 so that the deburring assemblies 30 undergo translational movement along the track slots 26 and 27.

In use, the sliders 32 are normally urged by gravity to the lower ends of the track slots 26 and 27 to the configuration illustrated in FIG. 1. As the knife blade is drawn between the deburring rods 30, the downward pressure on the rods 30 tends to move them apart, driving the intersection thereof downwardly along the knife slot 22, and forcing the rods 30 and the attached sliders 3 upwardly along the track slots 26 and 27.

The sliders 32 are arranged to facilitate assembly thereof with the frame 21. Thus, each of the sliders 32 will fit through the enlarged upper ends 28 of the lower track slots 27 for mounting on the raised ribs 29. Similarly, the lower ends of the upper track slots 26 are sufficiently wide to permit insertion of the upper sliders 32 therethrough to enable them to be mounted on the raised ribs 23*a* after the lower sliders 32 have been slid to the lower ends of the lower track slots 27.

However, this has caused difficulty in operation, since the upper sliders 32 tend to become disengaged from the ribs 23*a* and fall out of the upper track slots, particularly during cleaning with high pressure hoses. Furthermore, the upper sliders 32 sometimes tend to wedge in the narrowed upper ends of the upper track slots 26, preventing return of the deburring rods 30 to their normal rest position. Furthermore, it is possible for both of the upper sliders 32 to move up into a single one of the upper track slots 26 so that the intersection of the deburring rods 30 is moved out of alignment with the knife slot 22. Thus, when a knife edge is passed down through the gap 25, it may not pass between the two upper sliders 32 and into engagement with the deburring rods 30 at their intersection.

SUMMARY OF THE INVENTION

It is a general object of the present invention to provide an improved deburring apparatus which avoids the disadvantages of prior devices while affording additional structural and operating advantages.

An important feature of the invention is the provision of an edge maintaining or deburring apparatus which is characterized by ease of assembly, but which prevents the parts from accidentally becoming disassembled in use.

Another feature of the invention is the provision of an apparatus of the type set forth which insures that the deburring elements will remain in proper alignment during use.

Still another feature of the invention is the provision of an apparatus of the type set forth which is of relatively simple and economical construction.

These and other features of the invention ar attained by providing in an apparatus for maintaining a sharpened cutting edge on an elongated cutting tool, including a frame having formed therein an elongated tool slot open at one end thereof and adapted to receive the cutting edge therein and two elongated deburring elements disposed in an overlapping generally X-shaped configuration overlying and inclined with respect to the slot for engagement respectively with the opposite sides of a cutting edge received in the slot, and two pairs of elongated slide tracks on the frame respectively disposed at opposite ends of the tool slot an extending in opposite directions therefrom with the tracks of one pair being respectively parallel to the tracks of the other pair, the improvement comprising: four slide members respectively connected to the ends of the deburring elements and respectively disposed for sliding engagement with the slide tracks, and retaining means cooperating with the slide members and with the slide tracks for preventing disengagement of the slide members from the slide tracks while accommodating sliding movement of the slide members respectively longitudinally of the slide tracks for translational movement of the deburring elements relative to the tool slot.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a front perspective view of a prior art deburring device;

FIG. 2 is a rear perspective view of the device of FIG. 1;

FIG. 3 is a front perspective view of a deburring device constructed in accordance with the present invention, and illustrating the use thereof with an associated knife blade;

FIG. 4 is a rear perspective view of the device of FIG. 3;

FIG. 9 is an enlarged, fragmentary, cross-sectional view taken along the line 10-10 in FIG. 5; and FIG. 10 is an enlarged, fragmentary, cross-sectional view taken along the line 10-10 in FIG. 5; and FIG. 10 is an enlarged, fragmentary, perspective view illustrating the manner of assembly of one of the lower sliders with the frame of the device of FIG. 5.

DESCRIPTION OF THE PREFERRED EMBODIMENT

Figures 5, 6, 7, 8, 11:
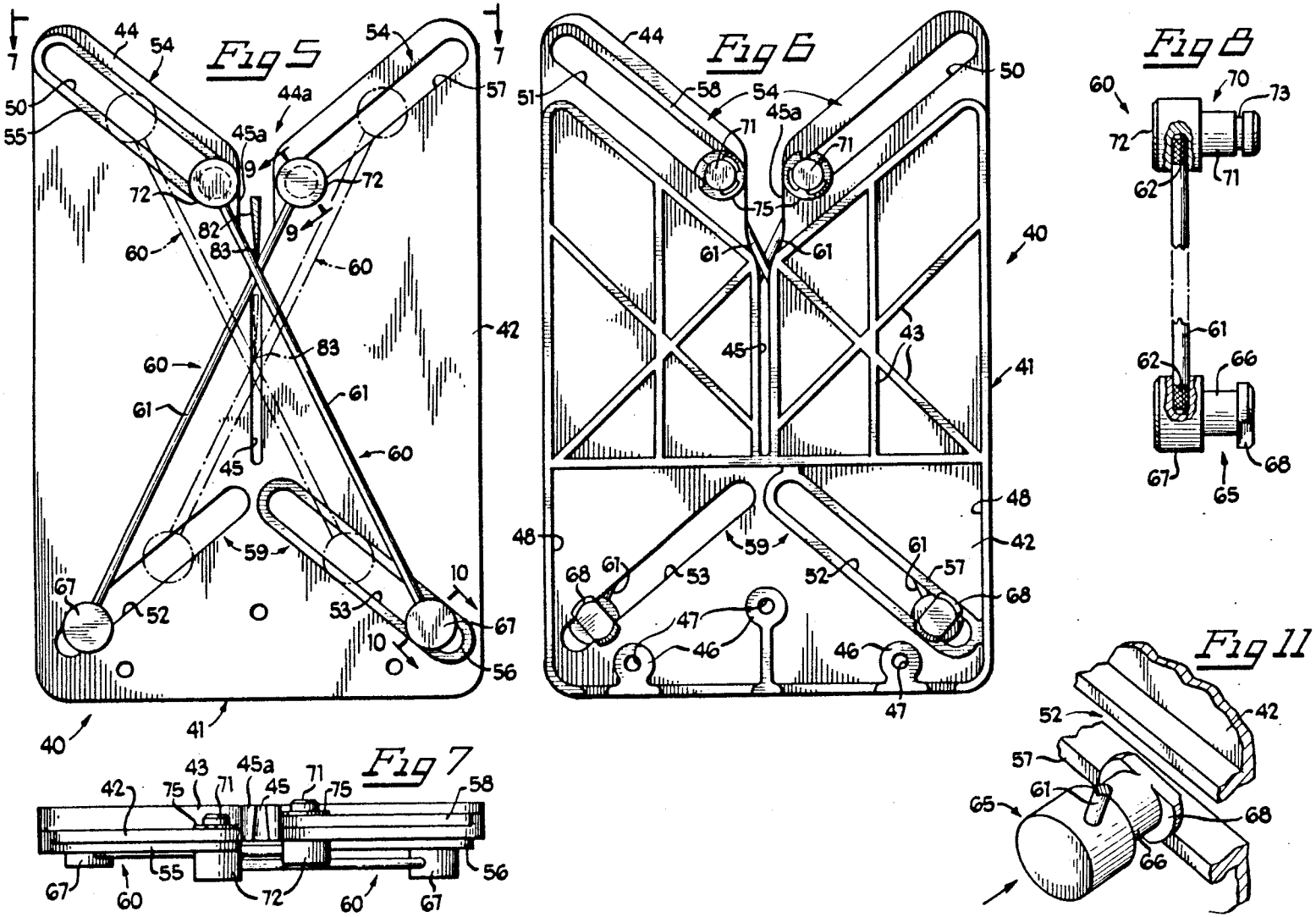
FIG. 5 is an enlarged front elevational view of the device of FIG. 3, illustrating the use with an associated knife blade and further illustrating movement of the parts during use.
FIG. 6 is a rear perspective view of the device of FIG. 5.
FIG. 7 is a top plan view of the device of FIG. 5.
FIG. 8 is a fragmentary elevational view in partial section of one of the deburring assemblies of the device of FIG. 5.

Referring to FIGS. 3–11, there is illustrated a deburring apparatus 40. The deburring apparatus includes a frame 41 in the form of a generally rectangular flat plate 42 provided with a plurality of stiffening ribs 43 projecting from the rear face thereof. The upper end of the plate 42 is notched to define a pair of downwardly and laterally inwardly inclined upper edges 44 which form a generally V-shaped notch 44*a*. The bottom of the notch 44*a* opens into the upper end of an elongated vertical knife slot·45 having a widened upper end 45*a*. Formed at the lower end of the plate 42 and projecting rearwardly therefrom are a plurality of bosses 46 defining bores 47 for receiving mounting screws or the like for fastening the frame 41 to an associated support, such as an edge of a work table. Integral with the plate 42 along the side edges thereof and projecting rearwardly therefrom are side flanges 48.

Formed through the plate 42 at the upper end thereof are two elongated upper slots 50 and 5!, respectively parallel to the upper edges 44 and extending substantially the entire length thereof (FIGS. 3–6). Similarly, there are formed through the plate 42 adjacent to the lower end thereof two upwardly and inwardly converging elongated lower slots 52 and 53, the upper ends of which terminate closely adjacent to each other and to the lower end of the knife slot 45. Extending around the perimeter of the upper slot 50 and projecting forwardly from the plate 42 is a front boss or lip 55 (FIGS. 3, 5 and 7). Similarly, a boss or lip 56 surrounds and projects forwardly from the lower slot 53. In like manner, a rear boss or lip 57 extends around the perimeter of the lower slot 52 and projects rearwardly from the plate 42, while a rear boss or lip 58 surrounds and projects rearwardly from the upper slot 51 (FIGS. 4, 5 and 7). It will be appreciated that the upper slots 50 and 51 and their corresponding bosses 55 and 58 cooperate to define a pair of upper slide tracks 54, while the lower slots 52 and 53 cooperate with their bosses 57 and 56 to define a pair of lower slide tracks 59.

The deburring apparatus 40 is also provided with a pair of deburring assemblies 60, which are substantially identical in construction. Each of the deburring assemblies 60 includes an elongated cylindrical deburring rod 61 having knurled ends 62 respectively adapted to be embedded din a lower slider 65 and an upper slider 70 (see FIG. 8). The lower slider 65 has a cylindrical shank 66 having a diameter slightly less than the width of the lower slots 52 and 53, the shank 66 being provided at one end with an enlarged cylindrical retaining head 67 having a diameter greater than the width of the lower slots 52 and 53. A knurled end 62 of the deburring rod 61 is received in a complementary bore in the retaining head 67. Integral with the shank 66 at the other end thereof is a generally rectangular retaining foot 68 having a width slightly less than and a length greater than the width of the lower slots 52 and 53. The upper slider 70 has a cylindrical shank 7! dimensioned to fit through the upper slots 50 and 51, and integral at one end thereof with an enlarged cylindrical retaining head 72 having a diameter greater than the width of the upper slots 50 and 51. The other knurled end 62 of the deburring rod 61 is received in a complementary bore in the retaining head 72. Formed in the shank 71 adjacent to the other end thereof is a circumferential groove 73. Preferably, the lower slider 65 and the upper slider 70 are of unitary, onepiece construction and may be formed by molding from a suitable material, such as a suitable plastic.

In assembling the deburring assemblies 60 with the frame 41, the lower slider 65 of one of the deburring assemblies 60 is first inserted through the lower slot 52 from the front of the plate 42 by aligning the long dimensions of the retaining foot 58 and the slot 52 (see FIG. 11). When the retaining foot 68 has been passed through the slot 52, the deburring assembly 60 is rotated to bring the shank 71 of the upper slider 70 into alignment with the upper slot 51 for insertion therethrough. It will be appreciated that the deburring assembly 60 has sufficient flexibility to accommodate this movement. A C-clip retainer 75 is then snapped into the circumferential groove 73 on the upper slider 70 along the rear face of the plate 42 for locking the deburring assembly 60 in place (FIGS. 6 and 9). It will be appreciated that, in this mounted configuration, the long dimension of the retaining foot 68 of the lower slider 65 is disposed generally perpendicular to the longitudinal axis of the lower slot 52 for preventing removal of the lower slider 65 therefrom (FIGS. 6 and 10).

The other deburring assembly 60 will then be mounted in the lower slot 53 and the upper slot 50 in the same manner, it being appreciated that the front bosses 55 and 56 serve to elevate this second deburring assembly 60 sufficiently to provide clearance above the first-mounted deburring assembly 60. The rear bosses 57 and 58 serve as spacers so that each of the slots 51 and 52 has the same front-to-back depth as the slots 50 and 53. This permits the use of identically constructed lower sliders 65 and identically constructed upper sliders 70.

It can be seen that when the deburring assemblies 60 are thus mounted in place, the deburring rods 61 will be crossed over each other and above the knife slot 45 in a generally X-shaped configuration. The slots 50 and 53 are parallel to each other, as are the slots 51 and 52, so that the lower and upper sliders 65 and 70 can move simultaneously therealong to accommodate translational movement of the deburring rods 6!. The inclination and spacing of the slots 50–53 are such that, in their mounted condition the angle between the deburring rods 61 is appropriate for efficient deburring of knife blades.

Referring to FIGS. 3, 5 and 6, the use of the deburring apparatus 40 will be described. There is illustrated a knife 80 having a handle 81 and a blade 82 with a cutting edge 83. In operation, the user places the blade 82 in the upper end of the knife slot 45 with the cutting edge 83 disposed downwardly for engagement with the deburring rods 61 at the intersection thereof. The widened end 45*a* of the knife slot 45 helps prevent engagement of the cutting edge 83 with the sides of the knife slot 45, which might nick the plate 42. The knife 80 is inserted as far as possible and then the blade is drawn forwardly and downwardly sliding the cutting edge 80 against the intersection of the deburring rods 61 thereby to remove burns from the edge to maintain the edge. The downward pressure of the knife blade 82 serves to urge the deburring rods 61 apart, tending to drive the intersection thereof downwardly along the knife slot 45 and urging the deburring assemblies 60 upwardly along the track slots 50–53 from the solid-line position to the broken-line position illustrated in FIG. 5. When the knife blade 8 is removed from the knife slot 45, the deburring assemblies 60 return by the force of gravity to their initial positions at the lower ends of the slots 50–53, as illustrated in FIGS. 3 and 6.

It is a significant aspect of the present invention that all of the slots 50–53 are of substantially the same length and width so as to inhibit the binding or snagging of the sliders 65 and 70 therein. Furthermore, the slots 50–53 are all discrete from one another and from the knife slot 45 so as to prevent the deburring assemblies 60 from moving into the wrong slots. Also, the deburring assemblies 60 are securely locked in place in the slide tracks 54 and 59 so as to prevent their accidental removal in use. However, the deburring assemblies 60 can be readily removed for repair or replacement by simply removing the C-clip retainers 75.

In will be appreciated that the deburring assemblies 60 may be reversed in assembly, i.e., they may be switched one for the other and/or each one may be flipped end-for-end so that the slider 65 is at the top and the slider 70 is at the bottom. In this way the life of the deburring assemblies 60 may be maximized by distributing the wear among both sides and both ends of each.

In a constructional model of the invention, the frame 41 and the sliders 65 and 70 are preferably molded of a suitable plastic, such as an acetyl copolymer, although it will be appreciated that other materials could be used. The deburring rods 61 may be formed of stainless steel with a coating of a material, such as that sold under the trademark MELONITE, to provide a hard, wear-resistent surface which cannot be cut into by the knife blade.

From the foregoing, it can be seen that there has been provided an improved deburring apparatus which provides deburring assemblies which are releasably but securely mounted in place so as to prevent accidental removal and to ensure proper alignment in use.

What is claimed is:

1. In an apparatus for maintaining a sharpened cutting edge on an elongated cutting tool, including a frame having formed therein an elongated tool slot open at one end thereof and adapted to receive the cutting edge therein and two elongated deburring elements disposed in an overlapping generally X-shaped configuration overlying and inclined with respect to the slot for engagement respectively with the opposite sides of a cutting edge received in the slot, and two pairs of elongated slide tracks on the frame respectively disposed at opposite ends of the tool slot and extending in opposite directions therefrom with the tracks of one pair being respectively parallel to the tracks of the other pair, the improvement comprising: four slide members respectively connected to the ends of the deburring elements and respectively disposed for sliding engagement with the slide tracks, and retaining means cooperating with said slide members and with the slide tracks for preventing disengagement of said slide members from the slide tracks while accommodating sliding movement of said slide members respectively longitudinally of the slide tracks for translational movement of the deburring elements relative to the tool slot.

2. The apparatus of claim i, wherein each of said slide members is fixed to the corresponding one of the deburring elements.

3. The apparatus of claim wherein the slide members connected to one of the deburring elements are respectively identical to the slide members connected to the other deburring element.

4. The apparatus of claim 1, wherein said retaining means includes means releasably coupling said slide members to the slide tracks.

5. The apparatus of claim wherein each of the deburring elements is an elongated cylindrical rod.

6. The apparatus of claim wherein each of the slide tracks is inclined in use with respect to the horizontal, said slide members being respectively urged by gravity toward the lower ends of the slide tracks.

7. In an apparatus for maintaining a sharpened cutting edge on an elongated cutting tool, including a frame having formed therein an elongated tool slot open at one end thereof and adapted to receive the cutting edge therein and two elongated deburring elements disposed in an overlapping generally X-shaped configuration overlying and inclined with respect to the tool slot for engagement respectively with the opposite sides of a cutting edge received in the tool slot, and two pairs of elongated slide tracks on the frame respectively disposed at opposite ends of the tool slot and extending in opposite directions therefrom with the tracks of one pair being respectively parallel to the tracks of the other pair, the improvement comprising: each of the slide tracks including means defining an elongated track slot wherein the four track slots are discrete from one another and from the tool slot, and four slide members respectively connected to the ends of the deburring elements and respectively disposed in the track slots for sliding engagement with the slide tracks.

8. The apparatus of claim 7, wherein the frame includes a plate, each of the track slots extending entirely through said plate.

9. The apparatus of claim 7, and further comprising retaining means cooperating with said slide members and with the slide tracks for preventing disengagement of said slide members from the slide tracks while accommodating sliding movement of said slide members respectively longitudinally of the slide tracks for translational movement of the deburring elements relative to the tool slot.

10. The apparatus of claim 9, wherein said retaining means includes enlarged retaining structure connected to each said slide member at each end thereof for engagement respectively with opposite sides of the frame.

11. The apparatus of claim 9, wherein said retaining means includes means releasably coupling each of the deburring elements to the slide tracks.

12. The apparatus of claim 7, wherein all of said track slots are of substantially the same length and width.

13. The apparatus of claim 7, and further comprising boss means projecting from one side of the frame for elevating two parallel ones of the slide tracks with respect to the other two slide tracks to provide clearance to facilitate overlapping movement of the deburring elements.

14. In an apparatus for maintaining a sharpened cutting edge on an elongated cutting tool, including a frame having formed therein an elongated tool slot open at one end thereof and adapted to receive the cutting edge therein and two elongated deburring elements disposed in an overlapping generally X-shaped configuration overlying and inclined with respect to the tool slot for engagement respectively with the opposite sides of a cutting edge received in the tool slot, and two pairs of elongated slide tracks on the frame respectively disposed at opposite ends of the tool slot and extending in opposite directions therefrom with the tracks of one pair being respectively parallel to the tracks of the other pair, the improvement comprising: each of the slide tracks including means defining an elongated track slot wherein the track slots are discrete from one another and from the tool slot, a pair of first slide members respectively connected to the deburring elements at one end thereof and respectively disposed in the track slots of one of the pairs of slide tracks for sliding engagement therewith, a pair of second slide members different from said first slide members respectively connected to the deburring elements at the other end thereof and respectively disposed in the track slots of the other pair of slide tracks for sliding engagement therewith, and retaining means cooperating with said slide members and with the slide tracks for preventing disengagement of said slide members from the slide tracks while accommodating sliding movement of said slide members respectively longitudinally of the slide tracks for translational movement of the deburring elements relative to the tool slot.

15. The apparatus of claim 14, wherein said retaining means includes means releasably coupling at least one of said pairs of slide members to the corresponding pair of slide tracks.

16. The apparatus of claim 14, wherein said retaining means includes means unitary with said first slide members and means removably coupled to said second slide members.

17. The apparatus of claim 16, wherein said retaining means includes means on each first slide member dimensioned and arranged so as to pass through the associated track slot in one orientation and to not pass through said track slot in another orientation.

18. The apparatus of claim 17, wherein each of said first and second slide members includes a shank dimensioned to pass through the associated track slot, said retaining means including an enlarged cylindrical head at one end of said shank of each of said first and second slide members having a diameter greater than the width of the associated track slot, and a rectangular foot at the other end of said shank of each of said first slide members having a width slightly less than and length greater than the width of the associated track slot.

19. The apparatus of claim 18, wherein said retaining means includes clips respectively releasably engageable with said shank of each of said second slide members and dimensioned so as to prevent removal of said shank from the associated track slot.

* * * * *

UNITED STATES PATENT AND TRADEMARK OFFICE

CERTIFICATE OF CORRECTION

PATENT NO. : 5,040,435

DATED : August 20, 1991

INVENTOR(S) : Ronald W. Millman

It is certified that error appears in the above-identified patent and that said Letters Patent is hereby corrected as shown below:

Column 6, line 45, "i" should be --1--;

line 48, after "claim" insert --1--;

line 55, after "claim" insert --1--; and line 57, after "claim" insert --1--.

Signed and Sealed this

Tenth Day of November, 1992

*Attest:*

DOUGLAS B. COMER

*Attesting Officer*

*Acting Commissioner of Patents and Trademarks*